US006528935B1

(12) United States Patent
Wakasono et al.

(10) Patent No.: US 6,528,935 B1
(45) Date of Patent: Mar. 4, 2003

(54) CATHODE-RAY TUBE

(75) Inventors: Hiromi Wakasono, Hyogo (JP); Yuichi Kimura, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 153 days.

(21) Appl. No.: 09/679,913

(22) Filed: Oct. 5, 2000

(30) Foreign Application Priority Data

Oct. 25, 1999 (JP) ..... 11-302154

(51) Int. Cl.[7] ..... H01J 29/10
(52) U.S. Cl. ..... 313/461; 313/477 R
(58) Field of Search ..... 313/461, 477 R

(56) References Cited

U.S. PATENT DOCUMENTS 4,535,907 A * 8/1985 Tokita et al. ..... 220/2.1 A
4,537,321 A * 8/1985 Tokita ..... 220/2.1 A
5,107,999 A * 4/1992 Canevazzi ..... 220/2.1 A
6,160,344 A * 12/2000 Cho et al. ..... 313/477 R
6,414,425 B1 * 7/2002 Yokota et al. ..... 313/461

FOREIGN PATENT DOCUMENTS

GB 0 825 632 A1 2/1998
JP 6-36710 2/1994
JP 10-64451 3/1998

* cited by examiner

*Primary Examiner*—Robert H. Kim
*Assistant Examiner*—Jurie Yun
(74) *Attorney, Agent, or Firm*—Merchant & Gould, P.C.

(57) ABSTRACT

A cathode-ray tube in which an outer surface of a face portion is substantially flat, an inner surface of the face portion is a curved surface convex to the outer surface, and when the axis extending approximately in parallel to a long side through the center of the inner surface is X-axis, the axis extending approximately in parallel to a short side through the center of the inner surface is Y-axis, the radius of curvature of the inner surface along the X-axis is Rx, the radius of curvature of the inner surface along the Y-axis is Ry, the radius of curvature of the inner surface along a long side of a phosphor screen is Rt, the length of a long side of the phosphor screen is H, and the length of a short side of the phosphor screen is V, the following inequalities are satisfied:

$$1.2H^{1.3923}<Rx<3.00H^{1.4284}, \quad (1)$$

$$1.2H^{1.3923}<Rt<3.00H^{1.4284}, \quad (2)$$

and $$3.0V^{1.4670}<Ry<6.67V^{1.5453}. \quad (3)$$

6 Claims, 3 Drawing Sheets

CATHODE-RAY TUBE

FIELD OF THE INVENTION

The present invention relates to a cathode-ray tube used in televisions and computer monitors, particularly to a cathode-ray tube having a particular face panel.

BACKGROUND OF THE INVENTION

In cathode-ray tubes including a face panel having an approximately flat outer surface, which have been spread recently, even if deflecting distortion of electron beams is completely extinguished, the periphery of the picture appears to be embossed due to the refraction of light at the face panel. That is, a phenomenon in which the picture appears to be concave is easily generated. Because this concave impression appears more conspicuously with the increase in the thickness of the face panel, it is preferable that the face panel has a smaller thickness so as to restrain this concave impression, as well as not to increase the weight of the cathode-ray tube. On the other hand, to ensure the compressive strength of the cathode-ray tube, which is a vacuum, because a face panel close to a flat surface is less advantageous than a curved face panel, it is better to make the thickness of the face panel larger if possible.

In order to solve such contradicting problems, for example, JP-A-10-64451 discloses a cathode-ray tube including a face panel in which the thickness of the periphery of the face panel in the horizontal direction is from 20 to 30% larger than that of the center of the face panel, so that the inner surface of the face panel becomes convex to the outer surface.

However, in the above-mentioned conventional cathode-ray tube, because the thickness of the periphery of the face panel is increased by 20 to 30% only in the horizontal direction, a natural flatness impression cannot be obtained due to the distortion of the picture, etc., and also it has not been able to deal with various sizes of the screen.

SUMMARY OF THE INVENTION

It is an object of the present invention to provide a cathode-ray tube that can obtain a natural flatness impression with different sizes.

In order to solve the above-mentioned problems, it is preferable that a first cathode-ray tube of the present invention includes an envelope comprising a face panel having an approximately rectangular face portion, an approximately rectangular phosphor screen being formed on an inner surface of the face portion, and a funnel at the rear of the face panel, wherein an outer surface of the face portion is substantially flat, the inner surface of the face portion is a curved surface convex to the outer surface, and when the axis extending approximately in parallel to a long side of the phosphor screen through the center of the inner surface is X-axis, the axis extending approximately in parallel to a short side of the phosphor screen through the center of the inner surface is Y-axis, the radius of curvature of the inner surface along the X-axis is Rx, the radius of curvature of the inner surface along the Y-axis is Ry, the radius of curvature of the inner surface along a long side of the phosphor screen is Rt, the length of a long side of the phosphor screen is H, and the length of a short side of the phosphor screen is V, the following inequalities are satisfied:

$$1.2\ H^{1.3923} < Rx < 3.00\ H^{1.4284}, \quad (1)$$

$$1.2\ H^{1.3923} < Rt < 3.00\ H^{1.4284}, \quad (2)$$

and $$3.0\ V^{1.4670} < Ry < 6.67\ V^{1.5453}, \quad (3)$$

and wherein the inner surface has no inflection point.

Accordingly, the picture of the cathode-ray tube can be watched with a flatness impression including a concave impression at a degree with no sense of incongruity.

Furthermore, in the first cathode-ray tube of the present invention, it is preferable that when the radius of curvature of the inner surface along a short side of the phosphor screen is Rs, the following inequality is satisfied:

$$3.0\ V^{1.4670}\ Rs < 6.67\ V^{1.5453}. \quad (4)$$

Furthermore, it is preferable that a second cathode-ray tube of the present invention includes an envelope comprising a face panel having an approximately rectangular face portion, an approximately rectangular phosphor screen being formed on an inner surface of the face portion, and a funnel at the rear of the face panel, wherein an outer surface of the face portion is substantially flat, the inner surface of the face portion is a curved surface convex to the outer surface, and when the axis extending approximately in parallel to a long side of the phosphor screen through the center of the inner surface is X-axis, the axis extending approximately in parallel to a short side of the phosphor screen through the center of the inner surface is Y-axis, the radius of curvature of the inner surface along the X-axis is Rx, the radius of curvature of the inner surface along the Y-axis is Ry, the radius of curvature of the inner surface along a long side of the phosphor screen is Rt, the length of a long side of the phosphor screen is H, and the length of a short side of the phosphor screen is V, the following inequalities are satisfied:

$$1.2\ H^{1.3923} < Rx < 1.97\ H^{1.4231}, \quad (5)$$

$$1.2\ H^{1.3923} < Rt < 1.97\ H^{1.4231}, \quad (6)$$

and $$3.0\ V^{1.4670} < Ry < 7.44\ V^{1.4566}, \quad (7)$$

and wherein the inner surface has no inflection point.

Accordingly, the picture of the cathode-ray tube can be watched with a natural flatness impression including no concave impression.

Furthermore, in the second cathode-ray tube of the present invention, it is preferable that when the radius curvature of the inner surface along a short side of the phosphor screen is Rs, the following inequality is satisfied:

$$3.0\ V^{1.4670} < Rs < 7.44\ V^{1.4566}. \quad (8)$$

Furthermore, in the first and second cathode-ray tubes of the present invention, it is preferable that Rx≈Rt or Ry≈Rs is satisfied.

Accordingly, the inner surface of the face portion can be of a simple structure.

PREFERRED EMBODIMENT OF THE INVENTION

An embodiment of the present invention is described below.

Figure 2:
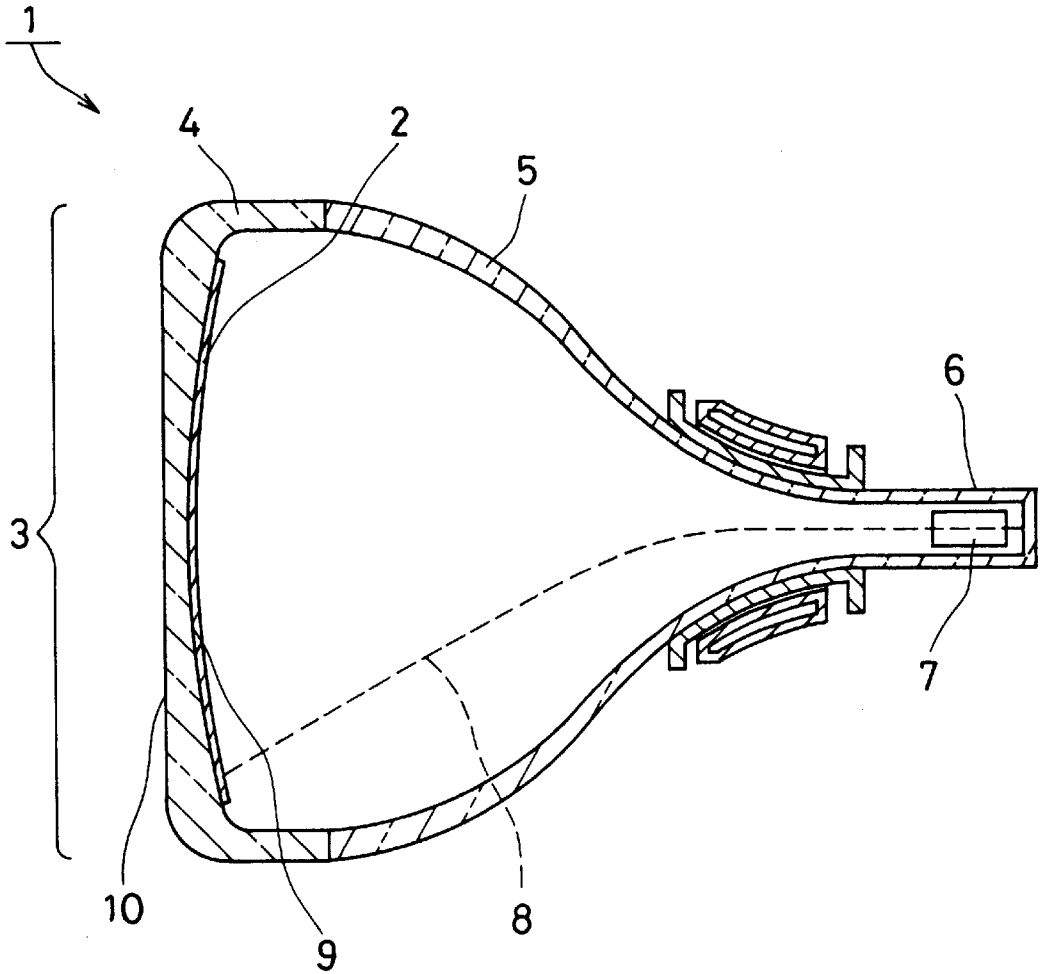
FIG. 2 is a partially sectional view showing a cathode-ray tube according to an embodiment of the present invention.

FIG. 2 is a partially sectional view showing a cathode-ray tube according to an embodiment of the present invention.

A cathode-ray tube 1 of this embodiment includes an envelope comprising a face panel 4 having a substantially rectangular face portion 3 in which a phosphor screen 2 is formed on an inner surface of the face portion 3, and a funnel 5 at the rear of the face panel 4. In the envelope, an electron beam 8 ejected from an electron gun 7, which is contained in a neck portion 6, is deflected to pass through an aperture in a shadow mask (not shown) and irradiate the phosphor screen 2, thereby projecting a picture on the face portion 3.

Next, as a feature of the present invention, the radius of curvature of the inner surface 9 of the face portion 3 on which the phosphor screen 2 is formed is further described.

Figure 3:
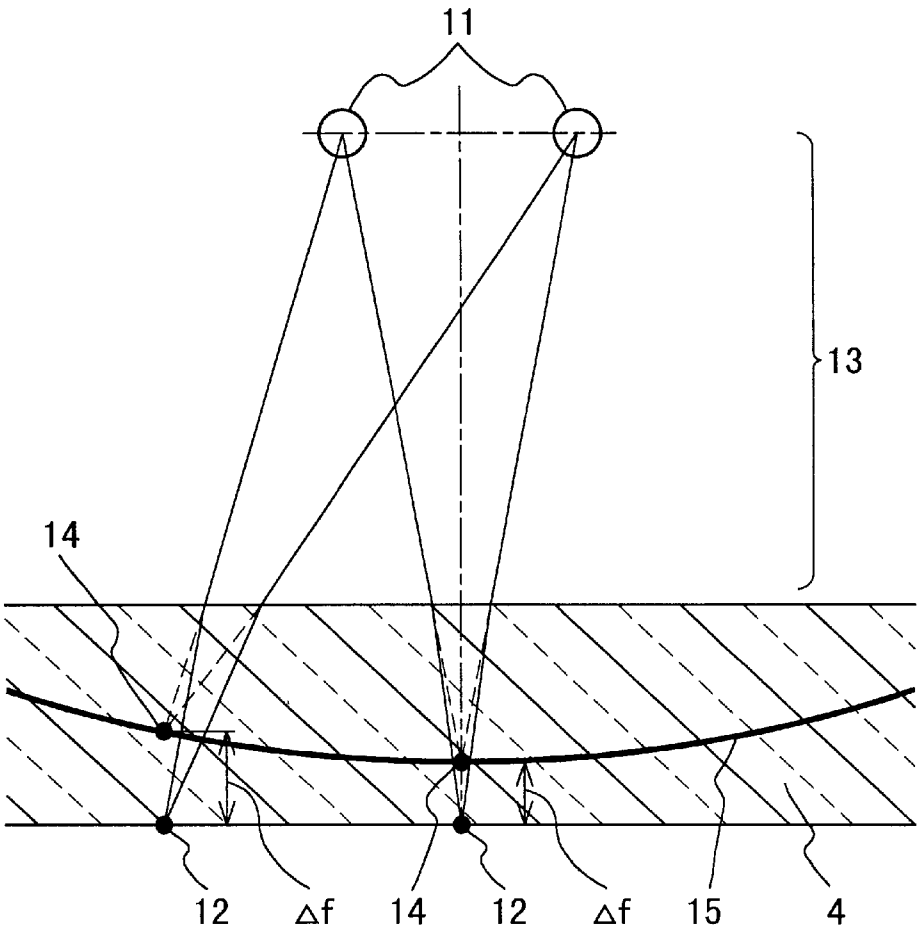
FIG. 3 is a drawing showing a relationship in position between a screen observer and an object picture.

FIG. 3 shows a relationship in position between eyes of an observer and an object picture when using a computer monitor. The object picture is formed on the phosphor screen that is formed on the inner surface of the face panel 4. In general, when an observer watches an object point 12 constituting the object picture with both eyes 11, at the same time with an adjusting action of focusing on the object point 12, there is an action of concentrating lines of sight of both eyes 11 on the object point 12. With this action, the observer perceives the distance between the object picture and himself/herself.

There are a space 13 and the face panel 4 (both the inner and outer surfaces are flat in this embodiment) between the observer and the object picture. Because a light of the object picture is refracted at the boundary face between the space 13 and the face panel 4 as indicated by a broken line, the picture watched by the observer is perceived to be embossed to virtual object points 14 from the actual positions. The embossed amount Δf at this time complies with the Snell's law. A curve 15 is formed by connecting the virtual object points 14 perceived by the observer. As shown in the drawing, the embossed amount increases with the increase in the incidence angles of the lines of sight with respect to the boundary face.

When the angle of visibility of the observer can be specified with the screen size and the distance between the screen and the observer, etc., the embossed amount is determined uniquely. In general, when the observer watches the screen of a television or a computer monitor, the concave impression due to the embossing of the periphery of the picture and the distortion of the picture become most conspicuous when the entire picture comes into view at maximum without excessiveness. Because the maximum angle of visibility at this time is in the range of 40 to 70 degree, it is desirable that the embossing of the picture is not conspicuous in this range.

Figure 1:
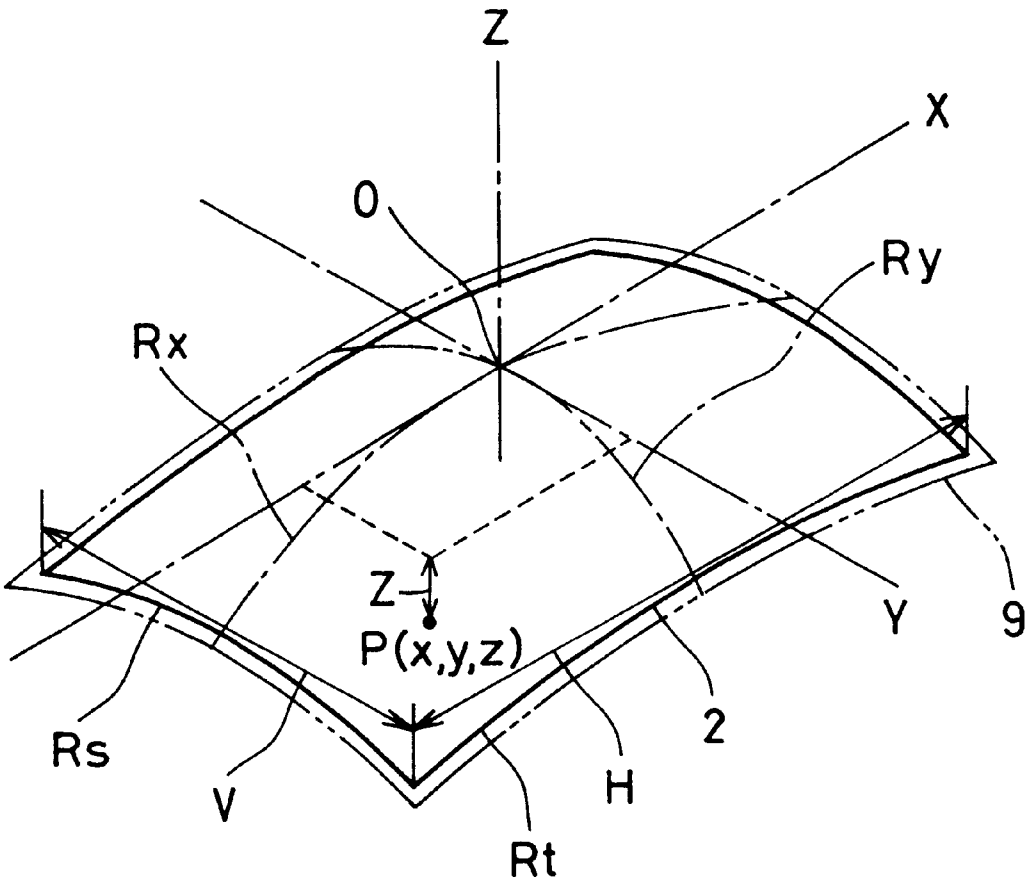
FIG. 1 is a perspective view showing an inner surface of a face portion of a cathode-ray tube according to an embodiment of the present invention.

In the embodiment of the present invention, the inner surface 9 of the face portion of the face panel is a curved surface convex to the outer surface 10 of the face portion, and has no inflection point as shown in FIG. 1. Now, when determining the center of the inner surface 9 of the face portion (a point of intersection between the tube axis of the cathode-ray tube 1 and the inner surface 9 of the face portion) as the origin O, and using a rectangular coordinate system comprising an X-axis extending approximately in parallel to a long side of the phosphor screen 2 through the origin O, a Y-axis extending approximately in parallel to a short side of the phosphor screen 2 through the origin O, and a Z-axis extending through the origin O in the direction of the normal line of the face portion (i.e. the tube axis): it is assumed that the difference in elevation Z in the direction of the tube axis between an arbitrary point P (x, y, z) on the inner surface 9 of the face portion and the center (the origin O) satisfies the relation $Z=a_1\cdot x^2+a_2\cdot x^4+a_3\cdot y^2+a_4\cdot x^2y^2+a_5\cdot x^4\cdot y^2+a_6\cdot y^4+a_7\cdot y^4+a_8\cdot x^4\cdot y^4$.

When the radius of curvature of the inner surface 9 of the face portion along the X-axis (the radius of curvature of the inner surface 9 of the face portion on the X-Z plane) is Rx, the radius of curvature of the inner surface 9 along the Y-axis (the radius of curvature of the inner surface 9 of the face portion on the Y-Z plane) is Ry, the radius of curvature of the inner surface 9 along a long side of the phosphor screen 2 is Rt, the radius of curvature of the inner surface 9 along a short side of the phosphor screen 2 is Rs, the length of a long side of the phosphor screen 2 is H, and the length of a short side of the phosphor screen 2 is V, the following inequalities are satisfied:

$$1.2\ H^{1.3923} < Rx < 3.00\ H^{1.4284}, \quad (1)$$

$$1.2\ H^{1.3923} < Rt < 3.00\ H^{1.4284}, \quad (2)$$

$$3.0\ V^{1.4670} < Ry < 6.67\ V^{1.5453}, \quad (3)$$

and $$3.0\ V^{1.4670} < Rs < 6.67\ V^{1.5453}. \quad (4)$$

In the above, the length H of a long side and the length V of a short side respectively refer to the length of a long side (in the direction of the X-axis) and the length of a short side (in the direction of the Y-axis) of the approximate rectangle obtained when projecting the phosphor screen 2 in the direction of the Z-axis.

Furthermore, these radii of curvature Rx, Rt, Ry and Rs mean radii of curvature determined equivalently from corresponding curves on the inner surface of the face portion.

As one embodiment of the present invention, a cathode-ray tube with a screen of 46 cm diagonal size (the length H of a long side of the phosphor screen is 365.8 mm, the length V of a short side of the phosphor screen is 274.3 mm) was used, and it was assumed that the difference in elevation Z between an arbitrary point on the inner surface of the face portion and the center satisfied the relation: $Z=a_1\cdot x^2+a_2\cdot x^4+a_3\cdot y^2+a_4\cdot x^2\cdot y^2+a_5\cdot x^4\cdot y^2+a_6\cdot y^4+a_7\cdot x^2\cdot y^4+a_8\cdot x^4\cdot y^4$, and also $$a_1=0.8352938\times10^{-4},$$

$$a_2=0.3987216\times10^{-12},$$

$$a_3=0.3500008\times10^{-4},$$

$$a_4=-0.7444962\times10^{-12},$$

$$a_5=-0.1212435\times10^{-19},$$

$$a_6=0.1662575\times10^{-13},$$

$$a_7=-0.1417633\times10^{-20},$$

and $$a_8=0.4690987\times10^{-27}.$$

At this time, the radius of curvature Rx along the X-axis was 5,990 mm, the radius of curvature Rt along a long side was 5,999 mm, the radius of curvature Ry along the Y-axis was 14,160 mm, and the radius of curvature Rs along a short side was 14,252 mm.

Thus, by making the shape of the inner surface of the face portion to satisfy the above inequalities (1) to (4), even with different sizes of a cathode ray tube, a flatness impression including a concave impression at a degree with no sense of incongruity can be obtained when watching the screen.

Furthermore, when a mechanism of adjusting the raster distortion of the right and left peripheries of the screen by a circuit, such as one included in a standard set in recent computer monitors using cathode-ray tubes, is provided in a circuit of the monitor, a natural flatness impression can be obtained by satisfying only the following three inequalities:

$$1.2\ H^{1.3923} < Rx < 3.00\ H^{1.4284}, \quad (1)$$

$$1.2\ H^{1.3923} < Rt < 3.00\ H^{1.4284}, \quad (2)$$

and $$3.0\ V^{1.4670} < Ry < 6.67\ V^{1.5453}. \quad (3)$$

This is because, when the raster distortion of the right and left peripheries of the screen can be corrected by a circuit as in the above, it is not particularly necessary to specify the inner surface of the face portion on the right and left short sides. Therefore, the above-mentioned inequality (4) becomes unnecessary. In this case, because the degree of freedom of designing the curved surface or the pitch of the apertures of a shadow mask set in the cathode-ray tube increases, a shadow mask strong to vibration and fall impact can be realized, and designing of a margin for color discrepancy can be performed with ease.

Furthermore, in this embodiment, although the inequalities (1) to (4) are used to obtain a picture not having a concave impression of a particular incongruity, to obtain a natural flatness impression not having a concave impression at all, it is preferable that the following inequalities are satisfied:

$$1.2\ H^{1.3923} < Rx < 1.97\ H^{1.4231}, \quad (5)$$

$$1.2\ H^{1.3923} < Rt < 1.97\ H^{1.4231}, \quad (6)$$

$$3.0\ V^{1.4670} < Ry < 7.44\ V^{1.4566}, \quad (7)$$

and $$3.0\ V^{1.4670} < Rs < 7.44\ V^{1.4566}. \quad (8)$$

When a mechanism of adjusting the raster distortion of the right and left peripheries of the screen by a circuit is provided in a circuit of a monitor, a natural flatness impression can be obtained without the inequality (8) in the same way as the above.

In this embodiment, although it has been described that the inner surface 9 of the face portion is a curved surface in which the difference in elevation Z from its center is expressed by $Z=a_1\cdot x^2+a_2\cdot x^4+a_3\cdot y^2+a_4\cdot x^2\cdot y^2+a_5\cdot x^4\cdot y^2+a_6\cdot y^4+a_7\cdot x^2\cdot y^4+a_8\cdot x^4\cdot y^4$, the inner surface of the face portion is not necessarily limited to a shape satisfying this formula, and it is satisfactory as long as it is a curved surface that is convex to the outer surface of the face portion and has no inflection point. For example, when the inner surface of the face portion is a curved surface satisfying Rx≈Rt or Ry≈Rs, it can have a simple shape.

Furthermore, although this embodiment has been described using a color cathode-ray tube having a shadow mask, it goes without saying that it also can be applied to monochrome cathode-ray tubes not having a shadow mask.

As described above, the present invention can provide a cathode-ray tube in which a picture with a natural flatness impression can be obtained with different screen sizes. Therefore, in cathode-ray tubes ranging from a relatively small one such as a monitor for a personal computer to a large one such as a television with a large screen, the picture can have a natural flatness impression without distortion.

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A cathode-ray tube including an envelope comprising a face panel having an approximately rectangular face portion, an approximately rectangular phosphor screen being formed on an inner surface of the face portion, and a funnel at the rear of the face panel, wherein:

an outer surface of the face portion is substantially flat;

the inner surface of the face portion is a curved surface convex to the outer surface; and when an axis extending approximately in parallel to a long side of the phosphor screen through a center of the inner surface is X-axis, an axis extending approximately in parallel to a short side of the phosphor screen through the center of the inner surface is Y-axis, a radius of curvature of the inner surface along the X-axis is Rx, a radius of curvature of the inner surface along the Y-axis is Ry, a radius of curvature of the inner surface along a long side of the phosphor screen is Rt, a length of a long side of the phosphor screen is H, and a length of a short side of the phosphor screen is V, the following inequalities are satisfied:

$$1.2H^{1.3923} < Rx < 3.00H^{1.4284}, \quad (1)$$

$$1.2H^{1.3923} < Rt < 3.00H^{1.4284}, \quad (2)$$

and $$3.0V^{1.4670} < Ry < 6.67V^{1.5453}. \quad (3)$$

and wherein the inner surface has no inflection point.

2. The cathode-ray tube according to claim 1, wherein when a radius of curvature of the inner surface along a short side of the phosphor screen is Rs, the following inequality is satisfied:

$$3.0V^{1.4670} < Rs < 6.67V^{1.5453}. \quad (4)$$

3. The cathode-ray tube according to claim 2, wherein Rx≈Rt or Ry≈Rs is satisfied.

4. A cathode-ray tube including an envelope comprising a face panel having an approximately rectangular face portion, an approximately rectangular phosphor screen being formed on an inner surface of the face portion, and a funnel at the rear of the face panel, wherein:

an outer surface of the face portion is substantially flat;

the inner surface of the face portion is a curved surface convex to the outer surface; and when an axis extending approximately in parallel to a long side of the phosphor screen through a center of the inner surface is X-axis, an axis extending approximately in parallel to a short side of the phosphor screen through the center of the inner surface is Y-axis, a radius of curvature of the inner surface along the X-axis is Rx, a radius of curvature of the inner surface along the Y-axis is Ry, a radius of curvature of the inner surface along a long side of the phosphor screen is Rt, a length of a long side of the phosphor screen is H, and a length of a short side of the phosphor screen is V, the following inequalities are satisfied:

$$1.2H^{1.3923}<Rx<1.97H^{1.4231}, \quad (5)$$

$$1.2H^{1.3923}<Rt<1.97H^{1.4231}, \quad (6)$$

and $$3.0V^{1.4670}<Ry<7.44V^{1.4566}. \quad (7)$$

and wherein the inner surface has no inflection point.

5. The cathode-ray tube according to claim 4, wherein when a radius curvature of the inner surface along a short side of the phosphor screen is Rs, the following inequality is satisfied:

$$3.0V^{1.4670}<Rs<7.44V^{1.4566}. \quad (8)$$

6. The cathode-ray tube according to claim 5, wherein Rx≈Rt or Ry≈Rs is satisfied.

* * * * *